US008712293B2

(12) United States Patent
Choi

(10) Patent No.: US 8,712,293 B2
(45) Date of Patent: Apr. 29, 2014

(54) TONER CARTRIDGE AND IMAGE FORMING APPARATUS INCLUDING THE SAME

(75) Inventor: Sam-seok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 547 days.

(21) Appl. No.: 12/957,714

(22) Filed: Dec. 1, 2010

(65) Prior Publication Data

US 2011/0150536 A1 Jun. 23, 2011

(30) Foreign Application Priority Data

Dec. 18, 2009 (KR) ..... 10-2009-0126930

(51) Int. Cl.
*G03G 15/06* (2006.01)

(52) U.S. Cl.
USPC ..... 399/254; 399/119; 399/262; 222/DIG. 1

(58) Field of Classification Search
USPC ..... 399/119, 254–256, 258–260, 262, 263; 222/DIG. 1, 649; 347/88
See application file for complete search history.

(56) References Cited

U.S. PATENT DOCUMENTS

2009/0097884 A1* 4/2009 Kim et al. ..... 399/254
2009/0290911 A1* 11/2009 Kimura et al. ..... 399/263
2009/0297226 A1* 12/2009 Nagashima et al. ..... 399/258

* cited by examiner

*Primary Examiner* — Walter L Lindsay, Jr.
*Assistant Examiner* — Jessica L Eley
(74) *Attorney, Agent, or Firm* — Stanzione & Kim, LLP

(57) ABSTRACT

Disclosed is a toner cartridge including a gear for rotating a rotatable member, for example, an agitator, of the toner cartridge and a support for rotatably supporting the gear. The gear includes a gear body, a coupling portion coupled to an end of the rotational shaft of the rotating member and a first position determining portion. The support includes a second position determining portion having a shape that corresponds to the shape of the first position determining portion so that the first and second position determining portions are capable of being coupled to each other. The gear is rotatable with the first and second position determining portions coupled to each other.

17 Claims, 10 Drawing Sheets

TONER CARTRIDGE AND IMAGE FORMING APPARATUS INCLUDING THE SAME

CROSS-REFERENCE TO RELATED APPLICATIONS

This application claims the benefit of Korean Patent Application No. 10-2009-0126930, filed on Dec. 18, 2009, in the Korean Intellectual Property Office, the disclosure of which is incorporated herein by reference in its entirety.

TECHNICAL FIELD

1. Field of the Invention

The present disclosure relates generally to a toner cartridge capable of containing developer therein and capable of being mounted in an image forming apparatus, and to an image forming apparatus including the toner cartridge.

2. Background of Related Art

Electrophotographic image forming apparatuses print or otherwise form an image on a recording medium such as, for example, on a sheet of printing paper, by irradiating light that is modulated to correspond to the desired image onto a photoconductor in order to form an electrostatic latent image on the surface of the photoconductor, by supplying toner to the electrostatic latent image in order to develop the electrostatic latent image into a visible toner image, and by transferring and fixing the toner image to the recording medium. Such Electrophotographic image forming apparatuses typically employ a toner cartridge for storing therein the toner. The toner cartridge may be detachably received in the image forming apparatuses, and may include therein one or more rotating devices such as, for example, an agitator, and one or more gears for driving the rotating devices.

SUMMARY

Irregular rotation of gears of a toner cartridge can adversely affects the image quality. Aspects of the present disclosure provide a toner cartridge capable of reducing the degradation of the image quality that may be caused by irregular rotation of gears of a toner cartridge, and an image forming apparatus including such a toner cartridge.

According to an aspect of the present disclosure, there may be provided a toner cartridge, which may include a housing, an agitator, a gear and a support. The housing may define a container in which to store developer. The agitator may be arranged rotatably in the housing in such a manner capable of agitating the developer contained in the housing. The gear may comprise a gear body, a coupling portion provided on a first side of the gear body and a first position determining portion provided on a second side of the gear body opposite the first side. The coupling portion may be capable of being coupled to an end of a rotational shaft of the agitator in such a manner that rotation of the gear causes the agitator to rotate. The support may be configured to rotatably support the gear, and may comprise a second position determining portion having a shape that corresponds to the first position determining portion so as to be capable of being coupled to the first position determining portion. The gear may be rotatable when the first position determining portion and the second position determining portion are coupled to each other.

One of the first and second position determining portions may comprise a position determination protrusion. The other one of the first and second position determining portions may comprise a rotation portion configured to receive the position determination protrusion such that the position determination protrusion is rotatable therein, a position determination groove configured to allow the position determination protrusion to be received into the rotation portion when the position determination groove and the position determination protrusion are mutually aligned and a separation preventing portion configured to interfere with a movement of the position determination protrusion in such a manner of preventing the position determination protrusion from escaping out of the rotation portion.

The gear may further comprise a shaft portion provided on the second side of the gear body. The support may comprise a shaft guide portion configured to rotatably support the shaft portion of the gear.

The gear may be arranged outside of a sidewall of the housing. The coupling portion may be inserted into the housing through a through-hole formed on the sidewall so as to be coupled to the end of the rotational shaft of the agitator that is disposed inside the sidewall of the housing.

The coupling portion may be of such shape that the coupling portion becomes engaged with the rotational shaft of the agitator as the coupling portion moves slidingly in a direction toward and along the rotational shaft of the agitator.

The support may be coupled to the sidewall of the housing.

The toner cartridge may further comprise a developing roller configured to carry the developer on an outer circumference thereof so as to move the developer outside the housing.

The toner cartridge may alternatively comprise a photoconductive drum and a developing roller configured to carry the developer on an outer circumference thereof so as to supply the developer contained in the housing to the photoconductive drum.

According to another aspect of the present disclosure, a toner cartridge may be provided to include a housing, a rotating member, a gear and a support. The housing may have a sidewall that at least in part defines a container in which to store developer. The rotating member may be rotatable about a rotational shaft, an end of which rotational shaft being disposed inside the housing. The gear may be provided outside the housing, and may comprise a gear body and a coupling portion provided on a first side of the gear body. The coupling portion may be receivable into the housing through a through-hole formed on the sidewall to thereby be coupled to the end of the rotational shaft of the agitator in such a manner that rotation of the gear causes the agitator to rotate. The support may be configured to rotatably support the gear from the second side opposite the first side of the gear body.

The coupling portion may be of such shape that the coupling portion becomes engaged with the rotational shaft of the agitator as the coupling portion moves slidingly in a direction toward and along the rotational shaft of the agitator.

The toner cartridge may further comprise a first position determination portion provided in one of the support and the second side of the gear body and a second position determination portion provided on the other remaining one of the support and the second side of the gear body. The first position determination portion may comprise a position determination protrusion. The second position determination portion may comprise a rotation portion, a position determination groove and a separation preventing portion. The rotation portion may be configured to receive the position determination protrusion such that the position determination protrusion is rotatable therein. The position determination groove may be configured to allow the position determination protrusion to be received into the rotation portion when the position determination groove and the position determination protrusion are mutually aligned. The separation preventing portion may be configured to interfere with a movement of the position determination protrusion in such a manner of preventing the position determination protrusion from escaping out of the rotation portion.

The gear may further comprise a shaft portion provided on the second side of the gear body. The support may comprise a shaft guide portion configured to rotatably support the shaft portion of the gear.

The support may be coupled to the sidewall.

The rotating member may comprise an agitator configured to agitate the developer contained in the housing.

According to yet another aspect of the present disclosure, an image forming apparatus for forming an image on a recording medium may be provided to include a main housing in which one or more component parts of the image forming apparatus are accommodated and a toner cartridge detachably received in the main housing. The toner cartridge may comprise a housing, a rotating member, a gear and a support. The housing may have a sidewall that at least in part defines a container in which to store developer. The rotating member may be rotatable about a rotational shaft, an end of which rotational shaft being disposed inside the housing. The gear may be provided outside the housing, and may comprise a gear body and a coupling portion provided on a first side of the gear body. The coupling portion may be receivable into the housing through a through-hole formed on the sidewall to thereby be coupled to the end of the rotational shaft of the agitator in such a manner that rotation of the gear causes the agitator to rotate. The support may be configured to rotatably support the gear from the second side opposite the first side of the gear body.

BRIEF DESCRIPTION OF THE DRAWINGS

Various features and advantages of the present disclosure will become more apparent by the following detailed description of several embodiments thereof with reference to the attached drawings, of which.

DETAILED DESCRIPTION OF THE EMBODIMENTS

Several embodiment of toner cartridge and image forming apparatus according to aspects of the present disclosure will now be described with reference to the accompanying drawings.

Figure 1:
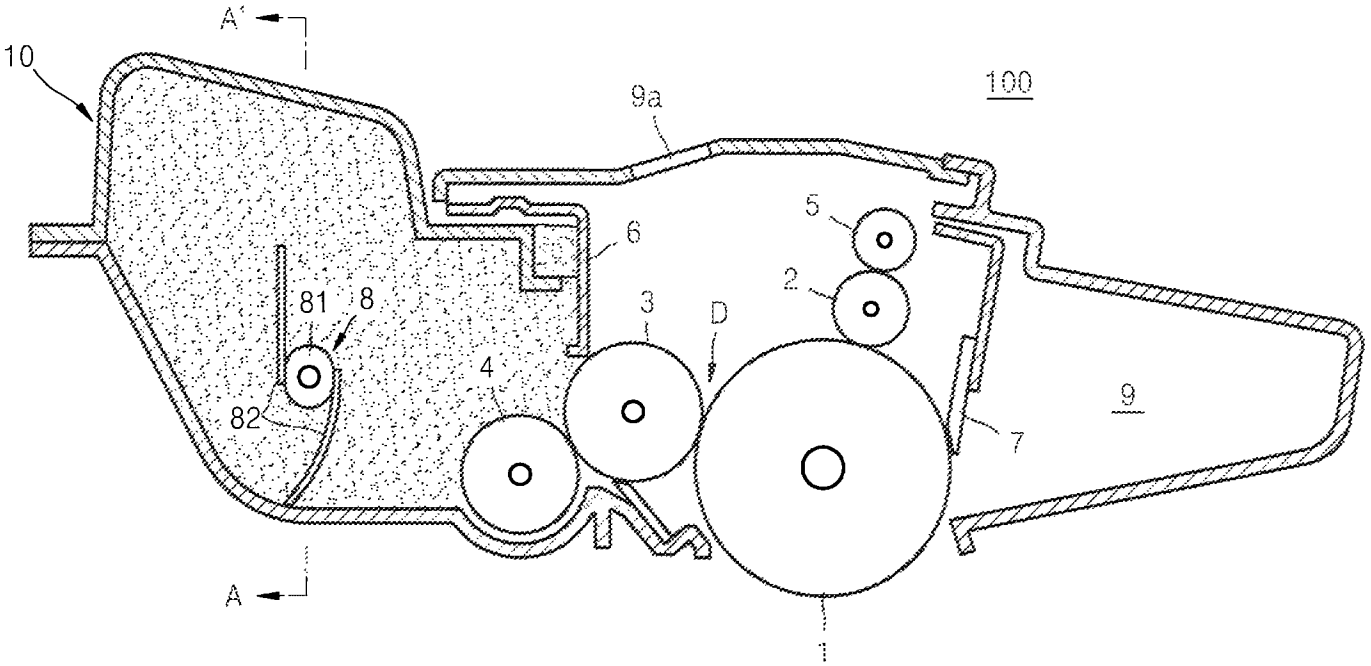
FIG. 1 is a schematic view showing the configuration of a toner cartridge according to an embodiment of the present disclosure.

FIG. 1 illustrates the configuration of a toner cartridge 100 according to an embodiment of the present disclosure. The toner cartridge 100 according to an embodiment may be a so-called one-body-type process cartridge that includes a photoconductive drum 1 and a developing roller 3, and that may be detachably received in a main body (see, e.g., 700 of FIG. 11) of an image forming apparatus. The toner cartridge 100 according to an embodiment may include toner, which may be considered a one-component developer. Hereinafter, for the sake of illustrative convenience, developer will be referred to as 'toner' unless stated otherwise, for example, in order to differentiate from the two-component developer.

The photoconductive drum 1 may include a photoconductive layer exhibiting photoconductivity that is formed around an outer circumference of a cylindrical metal pipe. A charging roller 2 may be in contact with the photoconductive drum 1. When a charging bias voltage is applied to the charging roller 2, the surface of the photoconductive drum 1 is charged to a uniform electrical potential. A light exposure device (not shown) may be provided to irradiate selective portions of the uniformly charged surface of the photoconductive drum 1 with light or pattern of light so as to cause the formation of an electrostatic image on the surface of the photoconductive drum 1 corresponding to the desired image to be formed. The electrostatic image is invisible, and takes the form of pattern of potential differences between those exposed portions and those unexposed portions of the surface of the photoconductive drum 1.

The developing roller 3 may be configured to supply the toner, which is stored in the housing 10 thereof, to the electrostatic latent image on the surface of the photoconductive drum 1 to thereby develop the electrostatic latent image into a visible toner image. The toner cartridge 100 according to an embodiment may use the so-called contact developing technique in which the developing roller 3 and the photoconductive drum 1 are in physical contact with each other to thereby form a development nip D therebetween. In such a case, the developing roller 3 may include an elastic layer (not shown) formed around the outer circumference of a conductive metal core (not shown). When a developing bias voltage is applied to the developing roller 3, the toner is transferred from the developing roller 3 via the development nip D to the photoconductive drum 1 in such a manner the toner selectively adheres to, and thus develop, the electrostatic latent image formed on the surface of the photoconductive drum 1. When, on the other hand, a non-contact developing technique is used, the surface of the developing roller 3 may be spaced apart from the surface of the photoconductive drum 1 by a gap, which may be, for example, on the order of several hundreds of microns.

The toner cartridge 100 may further include a supply roller 4 for conveying the toner contained in the housing 10 to the developing roller 3. A supply bias voltage may be applied to the supply roller 4 so as to promote the attaching of the toner onto the developing roller 3. Reference numeral 5 denotes a cleaning roller for removing material such as toner particles, dust, or other contaminant debris off the charging roller 2. Reference numeral 6 denotes a regulator that is configured to regulate the amount of toner that is attached to the surface of the developing roller 3 and that is being supplied to the development nip D. Reference numeral 7 denotes a cleaning blade for removing the residual toner and/or other foreign materials from the surface of the photoconductive drum 1 prior to the charging of the photoconductive drum 1. The residual toner and material removed from the surface of the photoconductive drum 1 by the cleaning blade 7 may be kept in a waste toner container 9.

An agitator 8 may be provided to cause the toner contained in the housing 10 to move in the direction toward the developing roller 3. Such an agitator 8 may agitate or stir the toner in the housing 10 so as to prevent the toner particles from forming into lumps, and, in so doing, may also frictionally charge the toner. While the example of the toner cartridge 100 of FIG. 1 is shown to include only one agitator 8, any number of agitators 8 variously positioned may be employed to effectively supply toner to the developing roller 3, taking into consideration factors, including, for example, the capacity and/or the shape of the housing 10. The agitator 8 may include a rotational shaft 81 and at least one agitating blade 82 that is coupled to the rotational shaft. As illustrated in FIG. 1, the agitating blade 82 according to an embodiment may be a film-shaped member coupled to the rotational shaft 81. Although not illustrated in FIG. 1, according to alternative embodiments, the agitating blade 82 may be a spiral screw or auger shaped member, and may be integrally formed with the rotational shaft 81.

An opening or window 9*a*, may be provided as an access path for light so that the light may pass therethrough to be incident upon the surface of the photoconductive drum 1 to thereby form an electrostatic latent image on the surface of the photoconductive drum 1.

While the toner cartridge 100 according to an embodiment is described above as employing an one-component type developer, it should be understood that alternative embodiments that utilizes two-component type developer is also possible, and is within the contemplated scope of the present disclosure. To that end, although not illustrated in FIG. 1, when the toner cartridge 100 contains two-component type developer that includes carrier and toner particles, the developing roller 3 may have the configuration that includes a magnet installed inside a hollow sleeve. Further, when a hybrid development technique that uses two-component type developer is being employed, a magnet roller for forming magnetic brushes of carrier and toner particles in supplying the toner to the developing roller 3 may additionally be provided in the housing 10.

Figure 2:
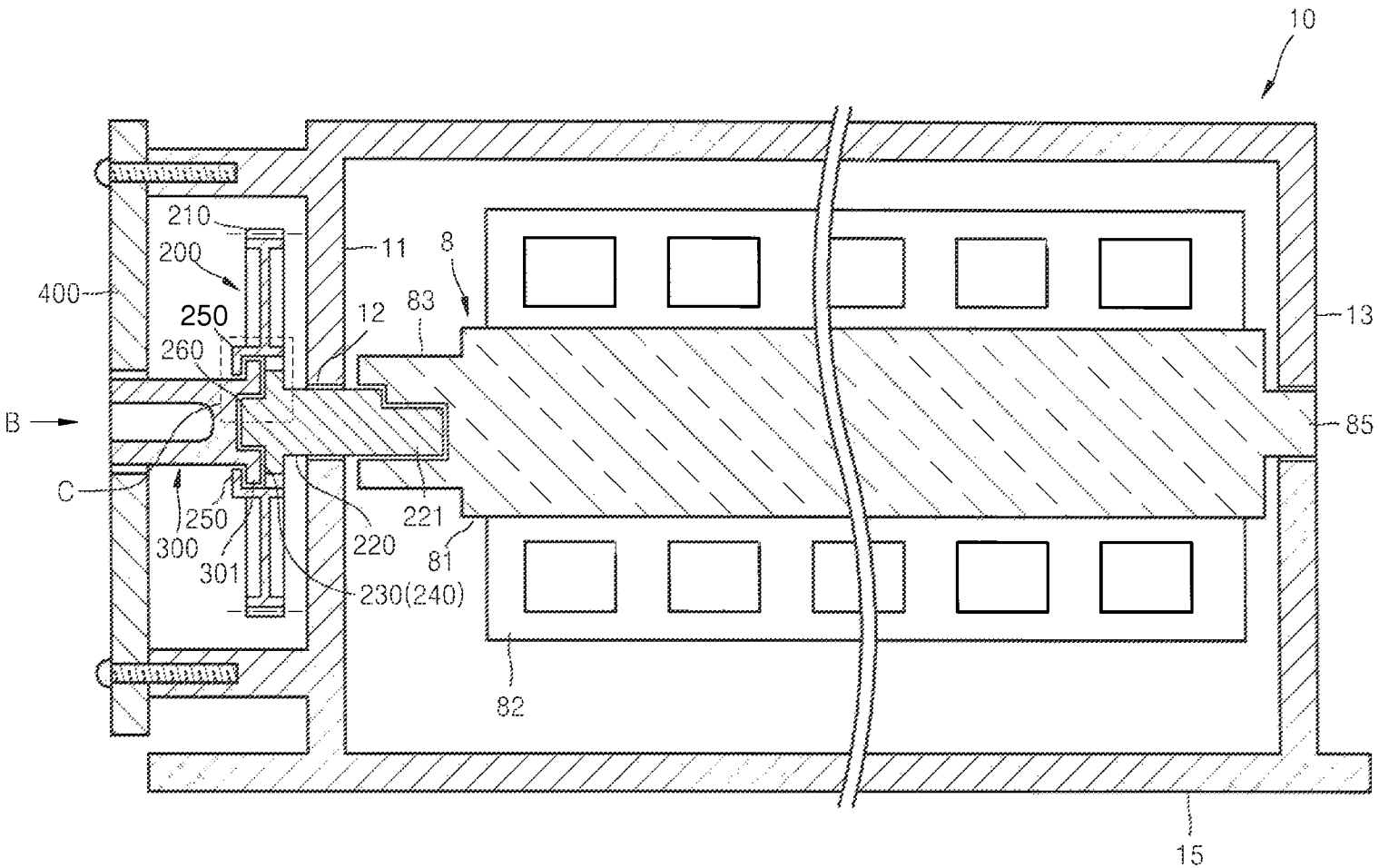
FIG. 2 is a cross-sectional view of the toner cartridge of FIG. 1 taken along the line A-A'.

FIG. 2 is a cross-sectional view of the toner cartridge 100 of FIG. 1 taken along the line A-A', and illustrates the coupling relationships between the agitator 8, a gear 200 for driving the agitator 8 and a support 300 for supporting the gear 200.

Figure 3:
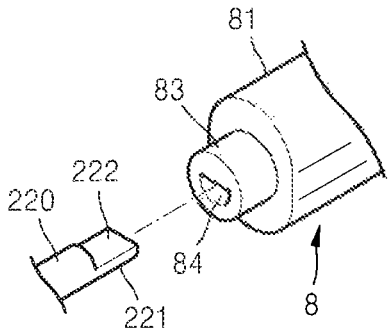
FIG. 3 is a partial perspective view illustrative of the coupling relationship between a coupling portion of a gear and a rotational shaft of an agitator depicted in FIG. 2.

With respect to the coupling relationship between the agitator 8 and the gear 200, in particular, referring to FIG. 2, the gear 200 includes a gear body 210 having one or more gear teeth. When the toner cartridge 100 is mounted in an image forming apparatus, the gear body 210 may be engaged with a driving mechanism (not shown) or the driving unit (not shown) provided in the image forming apparatus, which may include a gear train (not shown). A coupling portion 220 coupling the rotational shaft 81 of the agitator 8 with the gear body 210 may be arranged on a first side of the gear body 210 opposing the agitator 8. According to an embodiment, the gear 200 may be arranged outside the housing 10. In such an embodiment, the coupling portion 220 may be inserted from the outside into the housing 10 through a through-hole 12 provided on a sidewall 11 of the housing 10, and may become coupled to the rotational shaft 81 of the agitator 8 once properly received in the housing 10. To that end, the coupling portion 220 may be in the shape of a shaft that extends between the gear body 210 and an end 83 of the rotational shaft 81. The end portion 221 of the coupling portion 220 may be engaged with the end 83 of the rotational shaft 81 of the agitator 8 to thereby enabling the transfer of a rotational motion. For example, as illustrated in FIG. 3, the end 221 of the coupling portion 220 may include a D-shaped cut portion 222, and the end 83 of the rotational shaft 81 may include a D-shaped hole 84 into which the D-cut portion 222 is received. Alternatively, the end 221 of the coupling portion 220 may include a D-shaped hole and the end 83 of the rotational shaft 81 may include a D-shaped cut portion. While in the description above, the term 'D-shaped cut portion' is used, the cross-sectional shape of the cut portion may not be limited to the shape of the letter "D," and may have any shape that allows the two corresponding portions to slide into the coupling engagement with each other so that the two portions rotate together.

The coupling structure described above allows a convenient coupling of the agitator 8 to the housing 10. The installing of the agitator 8 may be performed prior to the covering of the top portion of the housing 10. As illustrated in FIG. 2, by placing the other end 85 of the rotational shaft 81 of the agitator 8 into the position so as to be supported by the other sidewall 13 of the housing 10, the end 83 of the rotational shaft 81 can be properly positioned inside the housing 10. According to an embodiment, when the agitator 8 is placed on the bottom frame 15 of the housing 10, the coupling portion 220 of the gear 200 may be inserted from the outside of the housing 10 through the through-hole 12 so as to be coupled to the rotational shaft 81. If, on the other hand, the end 83 of the rotational shaft 81 is made to extend out and beyond the housing 10 through the through-hole 12, the installation the agitator 8 may become difficult as the distance between the ends 83 and 85 of the rotational shaft 81 is greater than the distance between the sidewalls 11 and 13 of the housing 10.

The coupling relationship between the gear 200 and the support 300 will now be described in greater detail. Referring to FIGS. 2, 4, 5, and 6, a first position determining portion is disposed on a second side of the gear body 210 opposite the first side while a second position determining portion having a shape corresponding to that of the first position determining portion is formed in the support 300. According to an embodiment, the first and second position determining portions have the respective shapes such that the gear 200 rotates only when the first and second position determining portions are coupled to each other.

Figure 5:
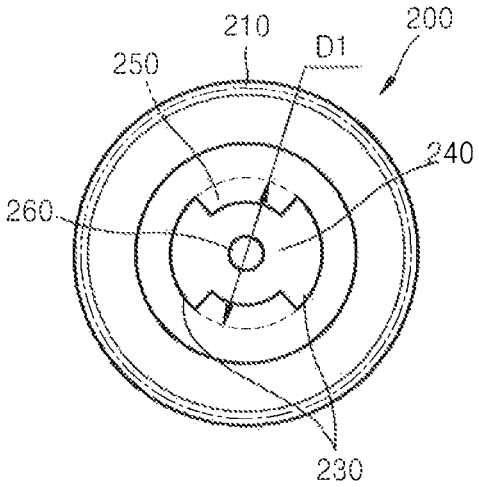
FIG. 5 is illustrative of the first position determining portion of the gear depicted in FIG. 2.
Figure 6:
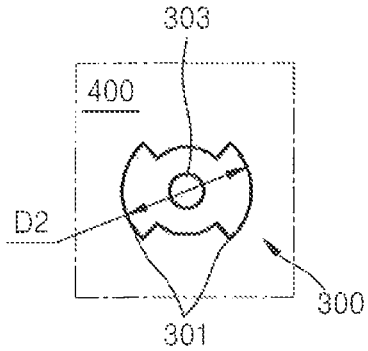
FIG. 6 is illustrative of the second position determining portion of the support depicted in FIG. 2.
Figure 7:
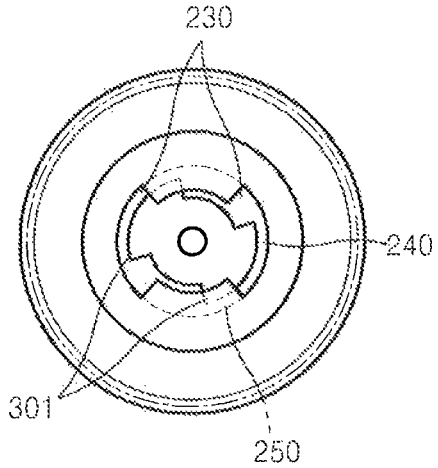
FIG. 7 is illustrative of first and second position determining portions being coupled to each other according to an embodiment of the present disclosure.

For example, according to an embodiment, the second position determining portion may be receivable into the first position determining portion. Referring to FIGS. 2, 4, 5 and 6, according to an embodiment, the support 300 may have the shape of a shaft that extends to the gear 200 whereas the second position determining portion has a position determination protrusion 301 having a blade shape at an end of the support 300. The first position determining portion includes a rotation portion 240, a position determination groove 230 and a separation preventing portion 250. The rotation portion 240 houses the position determination protrusion 301, and when the position determination protrusion 301 is housed in the rotation portion 240, the rotation portion 240 forms a space for allowing rotation of the gear 200. For example, the diameter D1 of the rotation portion 240 may be greater than the diameter D2 of the position determination protrusion 301. The position determination groove 230 extends radially out from the rotational center of the gear 200. The shape of the position determination groove 230 may correspond to the shape of the position determination protrusion 301. The position determination protrusion 301 may be inserted into the position determination groove 230, and may thereby be housed in the rotation portion 240. The separation preventing portion 250 may extend from an outer circumference of the rotation portion 240 radially and inwardly, with a fixed gap G between the separation preventing portion 250 and the rotation portion 240. The gap G may be slightly greater than the thickness T of the position determination protrusion 301. Thus, as illustrated in FIGS. 2 and 7, when the gear 200 rotates slightly when the position determination protrusion 301 is received in the rotation portion 240 through the position determination groove 230, the position determination protrusion 301 may be prevented from escaping from the rotation portion 240 by the separation preventing portion 250.

When the gear 200 is coupled to the rotational shaft 81 of the agitator 8, and with the position determination groove 230 and the position determination protrusion 301 aligned, the support 300 may be pushed in the B direction of FIG. 2 so that the position determination protrusion 301 is inserted into the position determination groove 230, and so that the position determination protrusion 301 is housed in the rotation portion 240. The support 300 may be coupled to the sidewall 11 of the housing 10 using a coupling member such as, for example, one or more screws as shown in FIG. 2. According to an embodiment, the support 300 may be formed on a supporting plate 400 that is to be coupled to the sidewall 11 of the housing 10, in which example, the gear 200 may be coupled to the support 300 when the supporting plate 400 is secured to the sidewall 11 with the position determination groove 230 and the position determination protrusion 301 in alignment.

In the above example, two position determination grooves 230 and two corresponding position determination protrusions 301 respectively received into the two position determination grooves 230 are shown. However, any number of position determination grooves and protrusions may be provided. That is, according to alternative embodiments, one position determination groove 230 or three or more position determination grooves 230 and one position determination protrusion 301 or three or more position determination protrusions 301 may be used. Depending on the particular application, as necessary, the two position determination grooves 230 may be identical to or different from each other whereas the shapes of the two position determination protrusions 301 may correspond respectively to the shapes of the two position determination grooves 230. For example, when a plurality of the agitating blades 82 are symmetric about the coupling portion 220, shapes of two position determination grooves 230 may be identical to each other. On the other hand, if the plurality of the agitating blades 82 are arranged asymmetrically about the coupling portion 220, the assembly of the gear 200 and positioning of the plurality of the agitating blades 82 may be made simpler by differentiating the shapes or the positions of the determination grooves 230. In addition, as necessary, the two position determination grooves 230 may be arranged symmetrically or asymmetrically about the rotational center of the gear 200.

In the embodiments described above, the gear 200 may also be supported rotatably by the support 300 by the virtue of the position determination protrusion 301 of the support 300 being supported by the rotation portion 240. In this regard, the diameter D1 of the rotation portion 240 may be selected to allow the outer circumference of the position determination protrusion 301 to be rotatably supported.

According to an embodiment, as illustrated in FIGS. 2, 3, 5, and 6, the shaft portion 260 having a convex shape may be formed on the gear body 210 while a shaft guide portion 303 having a concave shape may be formed in the support 300 to support the shaft portion. In this structure, the gear 200 may be supported rotatably with the support 300 by inserting the shaft portion 260 into the shaft guide portion 303. Alternatively, the shaft portion 260 may have a concave shape and the shaft guide portion 303 may have a convex shape.

When the teeth of the gear body 210 is non-uniform so as to result in a run-out of the gear body 210, or when the gear body 210 is eccentrically formed with respect to the rotational center of the gear 200, the rotation of the gear 200 may become irregular. The irregular rotation of the gear 200 may in turn result in an irregular rotation of the agitator 8. If the rotation of the agitator 8 becomes irregular, the amount of toner conveyed by such irregularly rotating agitator 8 to the developing roller 3 may not be uniform, possibly resulting in image defects. In addition, other gears connected to the gear 200 may also rotate irregularly. With the above described coupling configuration of the gear 200 and the support 300, the following effects may be obtained.

According to an embodiment, uniformity in the assembly of the gear 200 is possible due to the aligned coupling of the position determination groove 230 and the position determination protrusion 301. For example, if the position determination protrusion 301 is horizontally positioned as illustrated in FIG. 6, the gear 200 may be assembled into the toner cartridge while the position determination groove 230 is also horizontally positioned as illustrated in FIG. 5. Since the gears 200 of the toner cartridges 100 assembled as described above are uniform in their assembled state with respect to one another, even the printing defects due to rotational irregularity may also be uniform.

In addition, the agitator 8 may include one or more film-shaped agitating blades 82 for agitating, and/or for the movement, of the developer. According to aspects of the present disclosure, as the position determination groove 230 are arranged at a set relative angular position with respect to the coupling portion 220, the assembling of the cartridge with the position determination protrusion 301 and the position determination groove 230 in alignment as described above, the relative angular position(s) of the agitating blade(s) 82 may also be set so that all agitating blades 82 of toner cartridges 100 assembled as described above may have the same relative angular position with respect to the position determination protrusion 301. This may make possible to further reduce the non-uniformity in the amount of, or irregularities in the movement of, toner due to the irregular rotation of the gear 200 and thus the likelihood of printing defects resulting therefrom.

With the assembly process described above, the toner cartridge 100 may be assembled with uniformity in the orientation of gears 200 and in the angular position(s) of the agitating blade(s) 82, allowing the removal of the printing defects to become simpler task by, for example, changing the shape of the gears 200. In addition, the effects of such efforts to remove the defects may also manifest uniformly across toner cartridges, allowing an image forming apparatus employing the toner cartridge 100 according to above embodiments to produce images of uniform quality.

Figure 4:
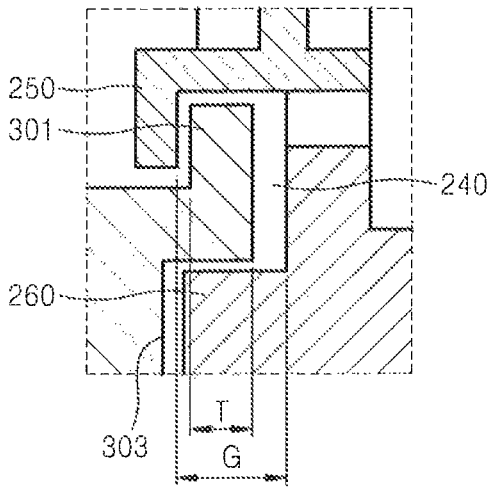
FIG. 4 is an enlarged view of the portion C of FIG. 2.
Figure 8:
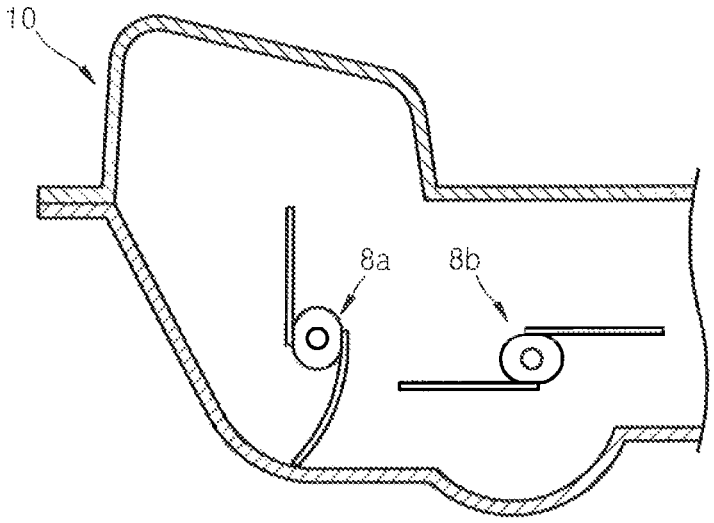
FIG. 8 is illustrative of a toner cartridge including two agitators according to an embodiment of the present disclosure.
Figure 9:
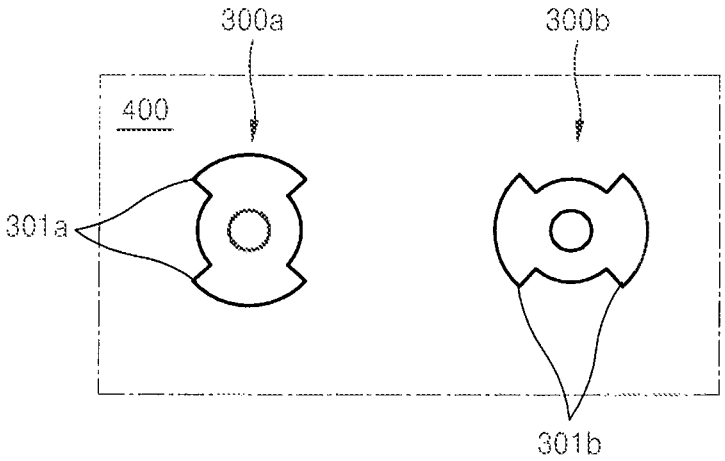
FIG. 9 is illustrative of a second position determining portion for aligning two agitators.

When a plurality of the agitators 8 are used, an optimal agitating and toner transfer performance may be realized by aligning the agitating blades 82 of the agitators 8 to have optimal relative angular positions. For example, as illustrated in FIG. 8, the optimal agitating and toner transfer performance may be realized by aligning the two agitators 8*a*, and 8*b*, to have a rotation phase difference of 90°. In such a configuration, the gears 200 for driving the agitators 8*a*, and 8*b*, may have the same structure as illustrated in FIG. 4 while the supporting plate 400 may be provided as illustrated in FIG. 9, that is, with the position determination protrusion 301*a*, of the support 300*a*, corresponding to the agitator 8*a*, and the position determination protrusion 301*b*, of the support 300*b*, corresponding to the agitator 8*b*, having the rotation phase difference of 90°, with respect to each other. According to an aspect of the present disclosure, since the alignment structure of the plurality of agitators 8 can be controlled only by changing the support 300, efforts to improve the performance of the toner cartridge 100 may be made easier.

In the embodiments described above, for the purposes of illustration, the first position determining portion is configured to be receivable into the second position determining portion. However, it should be understood that in alternative embodiments, the first position determining portion may include a position determination protrusion while the second position determining portion may include a position determination groove for receiving the position determination protrusion.

Figure 10:
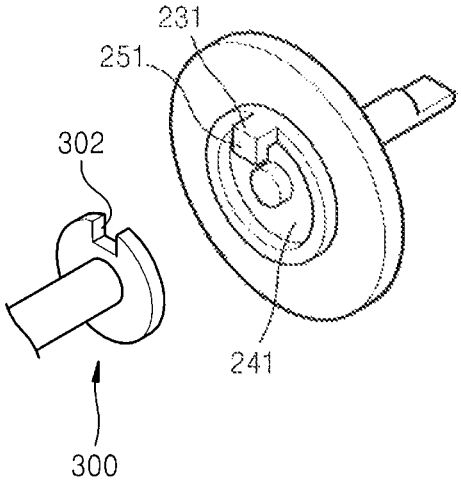
FIG. 10 is a partial perspective view of first and second position determining portions according to another embodiment of the present disclosure.

As illustrated in FIG. 10, according to an alternative embodiment, the second position determining portion may be of a blade shaped member having a position determination groove 302, and may be rotatably housed in the rotation portion 241 of the first position determining portion. In such a configuration, a separation preventing portion 251 may be provided so as to be capable of covering a portion of the blade-shaped second position determining portion to prevent the separation of the second position determining portion. The position determination protrusion 231 may also be provided so as to be receivable into the position determination groove 302.

It should be apparent to those skilled in the art from the above descriptions of several embodiments that the first and second position determining portions may have various other shapes as long as they have shapes that correspond to each other and are rotatable relative to one another.

Although examples of coupling configurations of the gear 200 for rotating the agitator 8 and the support 300 for supporting the gear 200 are described, such coupling configurations may also be applicable to coupling of various other rotatable members of the toner cartridge, including, for example, coupling the developing roller 3 and the gears (not shown) for driving the developing roller 3, the coupling of the photoconductive drum 1 and its driving gears (not shown) and coupling of the supply roller 4 with its driving gears (not shown). In this regard, according to an embodiment of the present disclosure, the supporting plate may have, in addition to or in lieu of the support 300 for the gear 200 driving the agitator 8, support(s) (not shown) corresponding to the developing roller 3, the photoconductive drum 1 and/or the supply roller 4.

Figure 11:
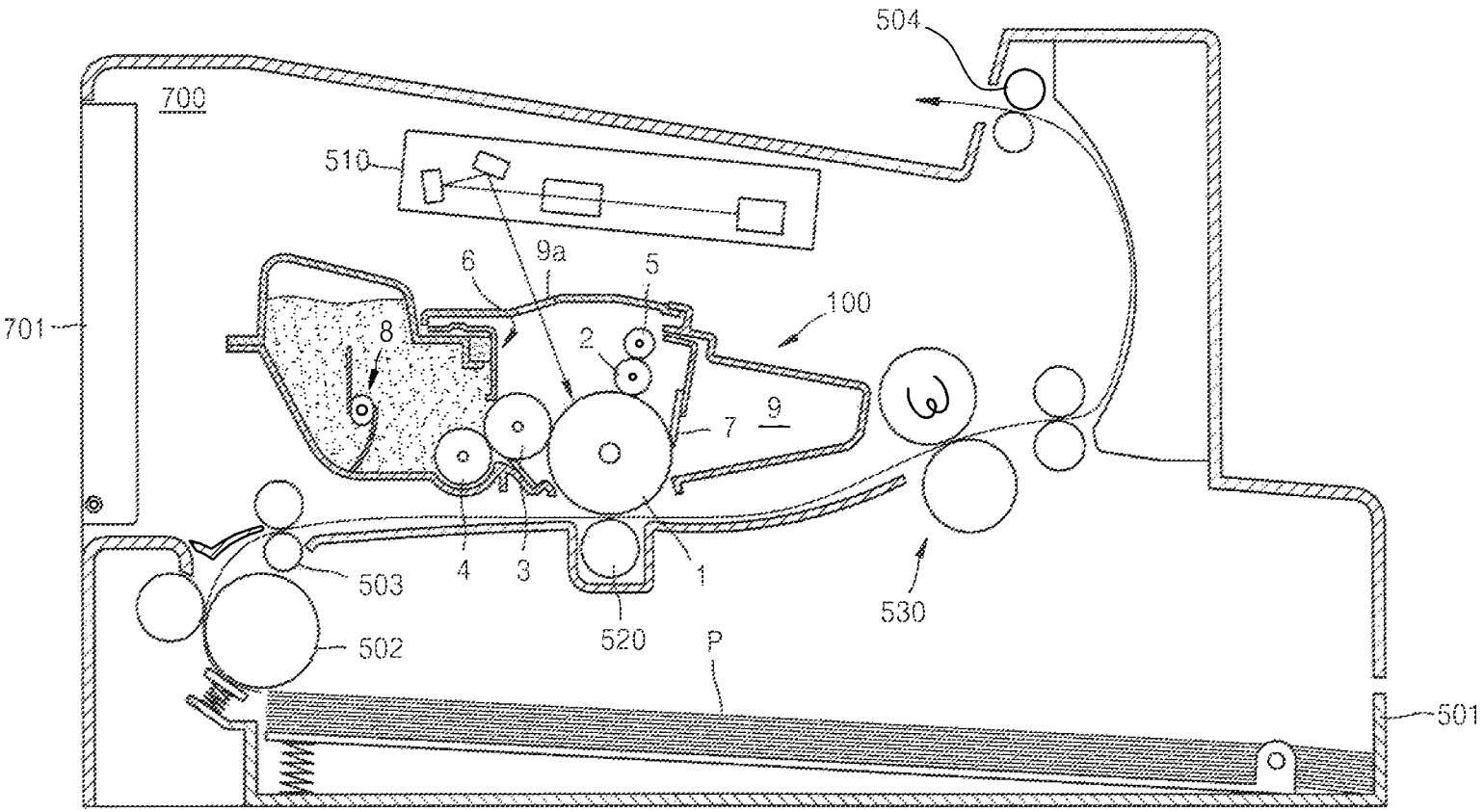
FIG. 11 is a schematic view showing the configuration of an image forming apparatus according to an embodiment of the present disclosure employing a toner cartridge depicted variously in FIGS. 1 through 10.

FIG. 11 is a schematic view showing an illustrative example of the configuration of an image forming apparatus employing the toner cartridge 100 illustrated in FIGS. 1 through 10 according to embodiments of the present disclosure. Referring to FIG. 11, the toner cartridge 100 may be mounted in the main body 700 of the image forming apparatus through an access door 701. When mounted, a driving source (not shown) provided in the main body 700 is connected to the gear 200 of the toner cartridge 100.

An optical scanning unit 510 scans light that is modulated according to image information onto the photoconductive drum 1 that has been charged to a uniform potential. For example, a laser scanning unit (LSU) that scans light emitted from a laser diode onto the photoconductive drum 1 by deflecting the light along a main scanning direction by the use of a polygon mirror may be used as the optical scanning unit 510.

A transfer roller 520, which is an example of a transfer unit, may be arranged to opposingly face the surface of the photoconductive drum 1 so as to form a transfer nip. A transfer bias voltage may be applied to the transfer roller 520 so as to transfer the toner image developed on the surface of the photoconductive drum 1 to a recording medium P passing through the transfer nip. Alternatively, a corona transfer unit may be used instead of the transfer roller 520. A fixing unit 530 may apply heat and/or pressure to the toner image so that the toner image is fixed to the recording medium P, thus completing the formation of a permanent printed image on the recording medium P.

An illustrative example of the method of forming an image using an image forming apparatus having the above configuration will now be briefly described. When a charging bias voltage is applied to the charging roller 2, the photoconductive drum 1 becomes charged to a uniform potential. The optical scanning unit 510 scans light that is modulated according to image information onto the photoconductive drum 1 through an opening 9*a*, of the toner cartridge 100, thereby forming an electrostatic latent image on the surface of the photoconductive drum 1. The toner is transferred toward the supply roller 4 by the agitator 8, and the supply roller 4 attaches the toner to the surface of the developing roller 3. The regulator 6 causes the toner layer on the surface of the developing roller 3 to have a uniform thickness. The toner that has moved to the development nip D as the developing roller 3 rotates attaches to the electrostatic latent image on the surface of the photoconductive drum 1 due to the developing bias voltage so that a visible toner image is formed on the surface of the photoconductive drum 1. A recording medium P picked up from a recording medium tray 501 by a pick-up roller 502 is transported to the transfer nip between the transfer roller 520 and the photoconductive drum 1 by a transporting roller 503. When a transfer bias voltage is applied to the transfer roller 520, the toner image is transferred from the photosensitive drum 1 to the recording medium P by electrostatic attraction. The transferred toner image is then permanently fixed to the recording medium P by being subjected to heat and pressure applied at the fixing unit 530, thus completing a printing operation. The recording medium P is then discharged from the image forming apparatus by a discharge roller 504. The toner remaining residual on the surface of the photoconductive drum 1 after the transfer of the toner image to the recording medium P is removed by the cleaning member 7, and is collected in the waste toner container 9.

Although the toner cartridge 100 according to an embodiment may be a one-body type process cartridge that includes both the photoconductive drum 1 and the developing roller 3 within one housing, alternative embodiments are possible.

Figure 12:
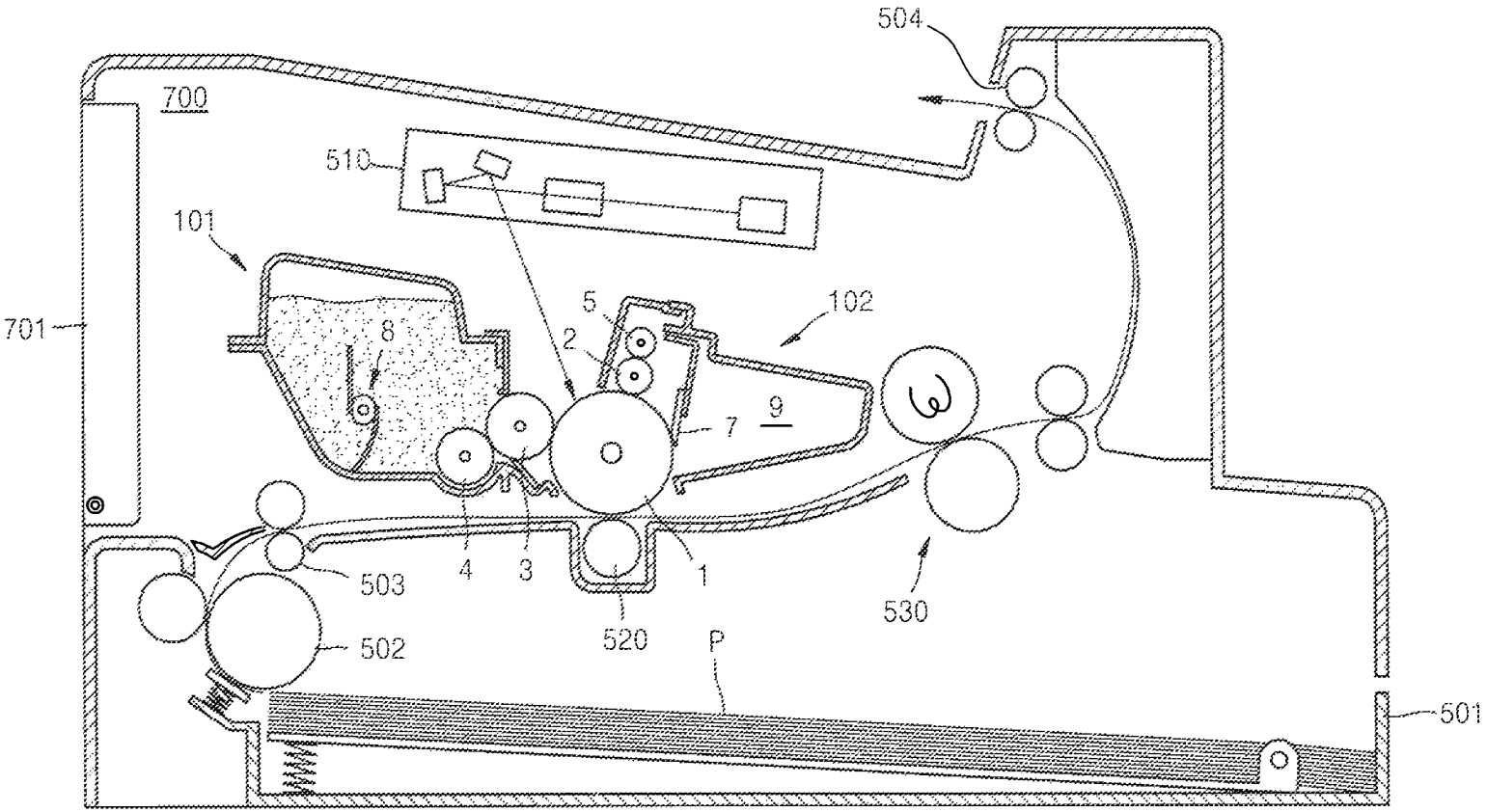
FIG. 12 is a schematic view of a toner cartridge according to an embodiment of the present disclosure that includes an agitator and a developing roller and of an image forming apparatus employing such a toner cartridge.

For example, as illustrated in FIG. 12, a photoconductive cartridge 102 including the photoconductive drum 1 may be provided separately so as to be mountable to and detachable from the main body 700 independently of the toner cartridge 101 that contains the toner to be supplied to the photoconductive drum 1. The toner cartridge 101 may includes the agitator 8 and the developing roller 3, and may be detachably received in the main body 700.

Figure 13:
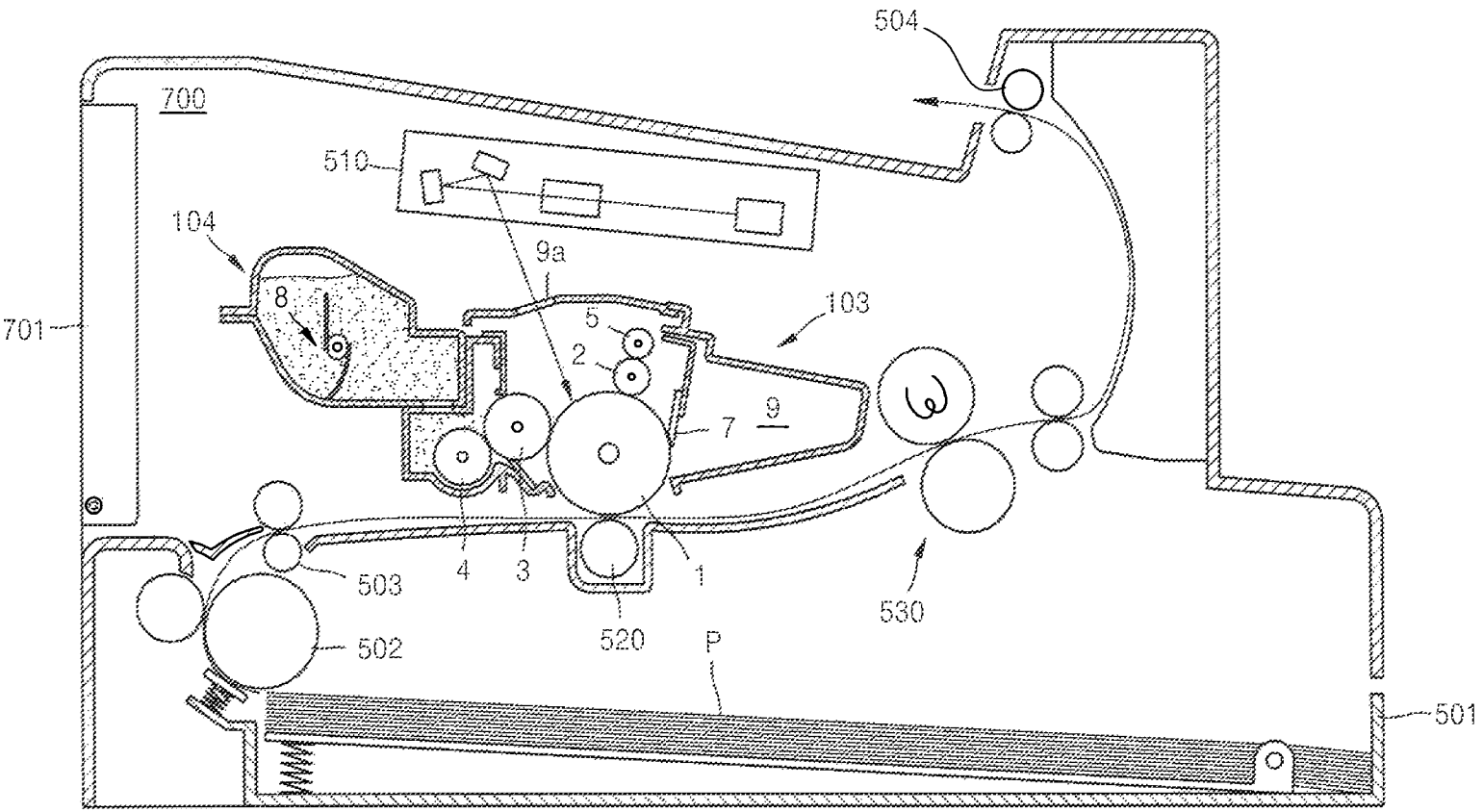
FIG. 13 is a schematic of a toner cartridge according to an embodiment of the present disclosure that include an agitator and of an image forming apparatus employing such a toner cartridge.

Alternatively, as illustrated in FIG. 13, a process cartridge 103 that includes the developing roller 3 and the photoconductive drum 1 may be provided to be mountable to and detachable from the main body 700 independently of the toner cartridge 104 containing the supply of toner for the process cartridge 103. The toner cartridge 104 may include the agitator 8.

A toner cartridge may refer to various containers of toner that includes at least one rotating member.

While aspects of the present disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A toner cartridge, comprising:

a housing defining a container in which to store developer;

an agitator arranged rotatably in the housing in such a manner capable of agitating the developer contained in the housing;

a gear comprising a gear body arranged outside of a sidewall of the housing, a coupling portion provided on a first side of the gear body and a first position determining portion provided on a second side of the gear body opposite the first side, the coupling portion being capable of being coupled to an end of a rotational shaft of the agitator in such a manner that rotation of the gear causes the agitator to rotate; and a support configured to rotatably support the gear, the support comprising a second position determining portion having a shape that corresponds to the first position determining portion so as to be capable of being coupled to the first position determining portion, wherein the gear is rotatable when the first position determining portion and the second position determining portion are coupled to each other, wherein one of the first and second position determining portions comprises a position determination protrusion, and wherein the other one of the first and second position determining portions comprises:

a rotation portion configured to receive the position determination protrusion such that the position determination protrusion is rotatable therein;

a position determination groove configured to allow the position determination protrusion to be received into the rotation portion when the position determination groove and the position determination protrusion are mutually aligned; and a separation preventing portion configured to interfere with a movement of the position determination protrusion in such a manner of preventing the position determination protrusion from escaping out of the rotation portion.

2. The toner cartridge of claim 1, wherein the gear further comprises a shaft portion provided on the second side of the gear body, and wherein the support comprises a shaft guide portion configured to rotatably support the shaft portion of the gear.

3. The toner cartridge of claim 2, wherein the coupling portion is inserted into the housing through a through-hole formed on the sidewall so as to be coupled to the end of the rotational shaft of the agitator that is disposed inside the sidewall of the housing.

4. The toner cartridge of claim 3, wherein the coupling portion is of such shape that the coupling portion becomes engaged with the rotational shaft of the agitator as the coupling portion moves slidingly in a direction toward and along the rotational shaft of the agitator.

5. The toner cartridge of claim 4, wherein the support is coupled to the sidewall of the housing.

6. The toner cartridge of claim 1, further comprising a developing roller configured to carry the developer on an outer circumference thereof so as to move the developer outside the housing.

7. The toner cartridge of claim 1, further comprising:

a photoconductive member; and a developing roller configured to carry the developer on an outer circumference thereof so as to supply the developer contained in the housing to the photoconductive member.

8. A toner cartridge, comprising:

a housing having a sidewall that at least in part defines a container in which to store developer;

an agitator rotatable about a rotational shaft, an end of which rotational shaft being disposed inside the housing;

a gear comprising a gear body provided outside the housing, and a coupling portion provided on a first side of the gear body, the coupling portion being receivable into the housing through a through-hole formed on the sidewall to thereby be coupled to the end of the rotational shaft of the agitator in such a manner that rotation of the gear causes the agitator to rotate;

a support configured to rotatably support the gear from a second side opposite the first side of the gear body;

a first position determination portion provided in one of the support and the second side of the gear body, the first position determination portion comprising a position determination protrusion; and a second position determination portion provided on the other remaining one of the support and the second side of the gear body, the second position determination portion comprising:

a rotation portion configured to receive the position determination protrusion such that the position determination protrusion is rotatable therein;

a position determination groove configured to allow the position determination protrusion to be received into the rotation portion when the position determination groove and the position determination protrusion are mutually aligned; and a separation preventing portion configured to interfere with a movement of the position determination protrusion in such a manner of preventing the position determination protrusion from escaping out of the rotation portion.

9. The toner cartridge of claim 8, wherein the coupling portion is of such shape that the coupling portion becomes engaged with the rotational shaft of the agitator as the coupling portion moves slidingly in a direction toward and along the rotational shaft of the agitator.

10. The toner cartridge of claim 8, wherein the gear further comprises a shaft portion provided on the second side of the gear body, and wherein the support comprises a shaft guide portion configured to rotatably support the shaft portion of the gear.

11. The toner cartridge of claim 8, wherein the support is coupled to the sidewall.

12. The toner cartridge of claim 8, wherein the agitator is configured to agitate the developer contained in the housing.

13. An image forming apparatus for forming an image on a recording medium, comprising:

a main housing in which one or more component parts of the image forming apparatus are accommodated;

a toner cartridge detachably received in the main housing, the toner cartridge comprising:

a cartridge housing having a sidewall that at least in part defines a container in which to store developer;

a rotating member rotatable about a rotational shaft, an end of which rotational shaft being disposed inside the cartridge housing;

a gear comprising a gear body provided outside the cartridge housing, and a coupling portion provided on a first side of the gear body, the coupling portion being receivable into the cartridge housing through a through-hole formed on the sidewall to thereby be coupled to the end of the rotational shaft of the rotating member in such a manner that rotation of the gear causes the rotating member to rotate;

a support configured to rotatably support the gear from a second side opposite the first side of the gear body;

a first position determination portion provided in one of the support and the second side of the gear body, the first position determination portion comprising a position determination protrusion; and a second position determination portion provided on the other remaining one of the support and the second side of the gear body, the second position determination portion comprising:

a rotation portion configured to receive the position determination protrusion such that the position determination protrusion is rotatable therein;

a position determination groove configured to allow the position determination protrusion to be received into the rotation portion when the position determination groove and the position determination protrusion are mutually aligned; and a separation preventing portion configured to interfere with a movement of the position determination protrusion in such a manner of preventing the position determination protrusion from escaping out of the rotation portion.

14. The image forming apparatus of claim 13, wherein the coupling portion is of such shape that the coupling portion becomes engaged with the rotational shaft of the rotating member as the coupling portion moves slidingly in a direction toward and along the rotational shaft of the rotating member.

15. The image forming apparatus of claim 13, wherein the gear further comprises a shaft portion provided on the second side of the gear body, and wherein the support comprises a shaft guide portion configured to rotatably support the shaft portion of the gear.

16. The image forming apparatus of claim 13, wherein the support is coupled to the sidewall.

17. The image forming apparatus of claim 13, wherein the rotating member comprises at least one selected from the group consisting of an agitator configured to agitate the developer contained in the cartridge housing, a developing roller configured to carry the developer on an outer circumference thereof so as to move the developer outside the cartridge housing and a photoconductor having a photosensitive surface.

* * * * *